US006527947B1

(12) United States Patent
Channing et al.

(10) Patent No.: US 6,527,947 B1
(45) Date of Patent: Mar. 4, 2003

(54) FUEL CONTROL DEVICE

(75) Inventors: Derek Albert Channing, Livonia, MI (US); Catherine Eileen Fratarcangeli, Canton, MI (US); Richard John Popeck, Warren, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/664,240

(22) Filed: Sep. 18, 2000

(51) Int. Cl.[7] ..... F02M 55/00

(52) U.S. Cl. ..... 210/136; 210/149; 210/167; 210/416.4; 210/428; 123/514; 123/516

(58) Field of Search ..... 210/85, 103, 105, 210/136, 167, 171, 172, 175, 180, 188, 416.4, 428, 742, 149; 123/220, 142.5, DIG. 2, 461, 464, 550, 514, 516

(56) References Cited

U.S. PATENT DOCUMENTS 4,478,197 A * 10/1984 Yasuhara et al.
4,502,451 A 3/1985 Duprez
4,589,395 A * 5/1986 Timms et al.
4,618,417 A * 10/1986 Yamanouchi et al.
4,625,701 A 12/1986 Bartlett et al.
5,685,278 A * 11/1997 Bradford et al.
5,887,573 A * 3/1999 Janik et al. ..... 123/514
6,289,879 B1 9/2001 Clausen et al.

OTHER PUBLICATIONS

Stanadyne Automotive Corporation, "Fuel Manager", 1998.

* cited by examiner

*Primary Examiner*—Joseph Drodge
*Assistant Examiner*—Terry K. Cecil
(74) *Attorney, Agent, or Firm*—Diana Brehob

(57) ABSTRACT

A fuel control device 220 includes a restriction 294 and a check valve 292 disposed between a fuel return conduit 236 and a fuel injection supply conduit 227. In operation, fuel from tank 202 flows into the control device via conduit 208 is filtered through filter 222 flowing to an injection pump 230 outlet conduit 228. Excess fuel is returned to the control device and is then directed either back to the tank 202 via conduit 234 or is mixed with incoming fuel via conduit 235 and a two-position temperature responsive diverter valve 290. The restriction and check valve provide the benefit of allowing a continuous air bleed to purge any incoming air or vapor from the fuel supply system back to the fuel tank 202, while preventing unfiltered fuel flow from the fuel return outlet port to the filtered fuel outlet port.

1 Claim, 6 Drawing Sheets

FUEL CONTROL DEVICE

BACKGROUND OF THE INVENTION

1. Field of the Invention

The invention relates to a fuel control device, including an integral return fuel temperature diverter, to prevent cold clogging of the fuel filter media and also, modifications to improve air separation from the pressurized version.

2. Discussion of the Related Art

Fuel control devices are used in vehicle propulsion systems that use various fuels including diesel fuel. Stanadyne Corporation makes one example of a diesel fuel control device. These diesel fuel control devices can include an electric fuel pump and fuel pressure regulator. The electric pump and pressure regulator, modularly replace the hand primer pump, which has also been used in other fuel control devices.

Several diesel fuel filter system manufacturers have products that include optional electric fuel heaters. Under cold operating conditions, the electric fuel heater will warm the incoming fuel, preventing the formation of wax crystals on the fuel filter media that would otherwise have the effect of choking the filter media.

Diesel fuel systems have always had fuel returned to the fuel tank. Therefore the fuel supply flow is the sum of the fuel burned by the engine for power, plus the fuel flow returned to the fuel tank. As diesel fuel injection pressures have increased to meet modern emissions standards, the fuel injection systems have generated more heat and the fuel return flows have increased, as this fuel is now used for cooling the injection system. As the return flow increased, so did the supply flow. Under cold conditions, bigger electric fuel heaters were required to increase the fuel temperature to a level where wax would not form on the filter media. As the electric power for these heaters became difficult to manage, other methods of heating the supply fuel were initiated, including systems that used the heat in the return fuel.

Several diesel fuel filter systems have a return fuel temperature diverter system. The purpose of this diverter system is to permit the heat in the return fuel, to be used to raise the supply fuel temperature, to prevent wax formation on the filter media. However, once the engine warmed up and the return fuel became hot, it was then desirable to return it to the fuel tank directly. The return fuel diverter system then included a temperature sensitive component, such as a wax motor or bi-metal device, that would sense the temperature of the fuel supply and then provide activation for a diverter valve. If the temperature was low, then the warm return fuel was blended with the supply fuel. If the temperature was high, then the hot return fuel was diverted directly back to the fuel tank, sometimes through a fuel cooler.

SUMMARY OF THE INVENTION

The present invention combines the modular features of previous fuel control device systems with an integral temperature diverter system. Both a bi-metal disc and a wax capsule have been used to provide activation for the diverter valve. An electronic temperature sensor sending a signal to an electronic control module that activates a solenoid controlled diverter valve is also considered.

Under cold conditions, the temperature sensor permits the diverter valve to open, such that the return fuel is diverted to blend with the incoming supply fuel. The path back to the fuel tank is substantially blocked by a biased (loaded) check valve. Some leakage past the check valve is desirable (10% for example), to remove entrapped air from the system, as well as to provide some early heat for the return fuel system components.

Under hot conditions, the diverter valve is closed, mostly blocking the return fuel path to the supply side of the fuel filter. Some leakage past the diverter valve may be permissible (5% for example). Under these conditions, the biased check valve would open, permitting the return fuel to go back to the fuel tank. The biased check valve causes a minimal permissible back pressure in the fuel injection return system.

The diverter system was applied to two versions of a fuel control device. One version has an electric fuel pump and a fuel pressure regulator. The other version uses the mechanical fuel feed pump that is integral with the fuel injection system. This filter system incorporates a less expensive hand operated priming pump than is used to fill the system with fuel and purge any entrapped air, after a service event.

For the system that uses an electric fuel feed pump and a pressure regulator, this invention proposes adding a continuous air bleed orifice system, from the supply side of the fuel pressure regulator, to the fuel tank return fuel port in the fuel filter head. This air bleed purges any incoming air or vapor from the fuel supply system, back to the fuel tank. Otherwise, this air or vapor would only be able to leave through the fuel injection pump, which is undesirable.

The air bleed passage also includes a check valve in series with the orifice. In the event of an electric fuel pump failure, this check valve would prevent unfiltered fuel from being pulled along the fuel tank return line, by the mechanical feed pump that is integral with some fuel injection systems.

BRIEF DESCRIPTION OF THE DRAWINGS

The above and other objects and features of the present invention will be clearly understood from the following description with respect to the preferred embodiment thereof when considered in conjunction with the accompanying drawings and diagrams, in which.

DETAILED DESCRIPTION OF THE PREFERRED EMBODIMENTS

Figure 1:
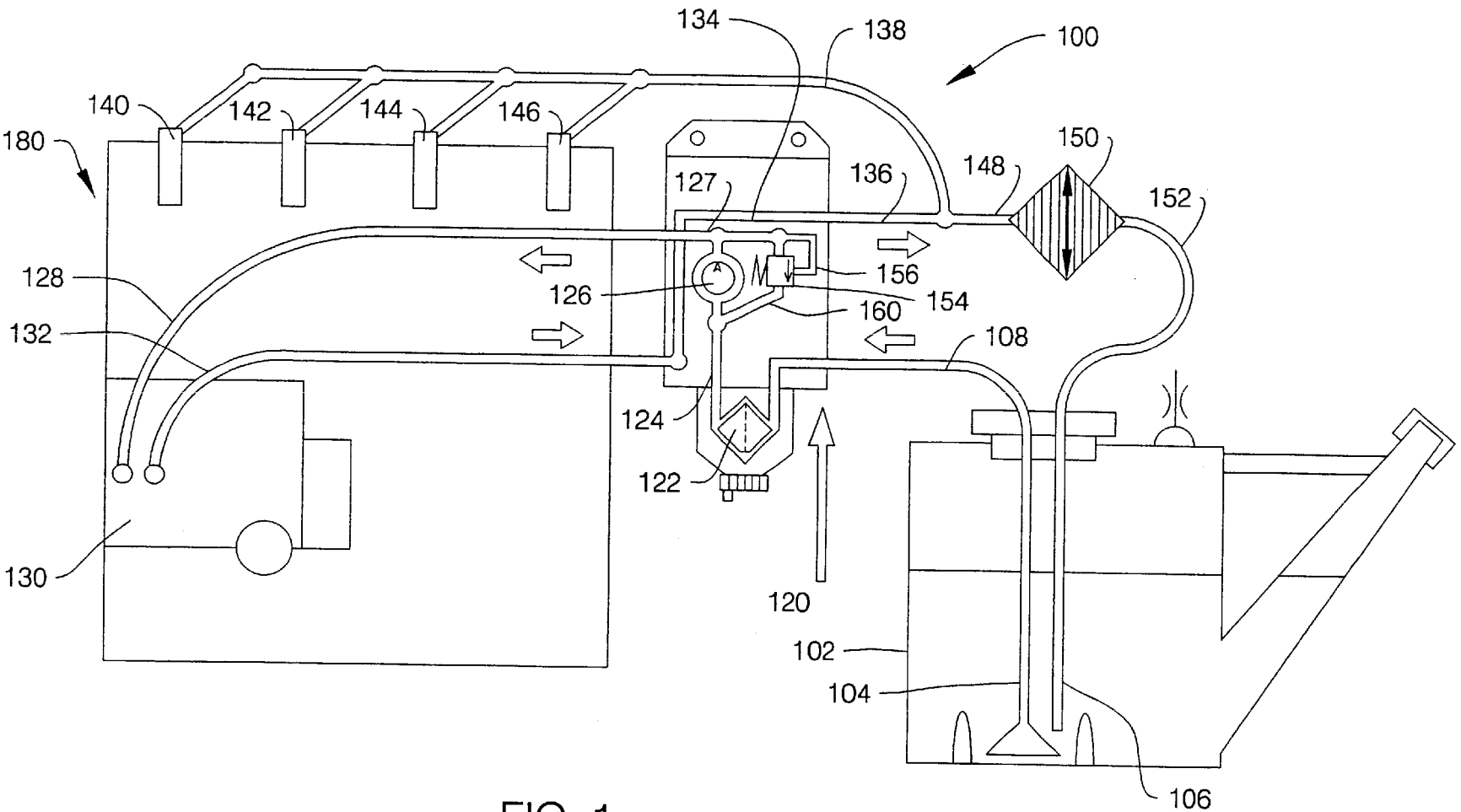
FIG. 1 (PRIOR ART)
FIG. 1 is a schematic view of a diesel fuel control device illustrating the operation of a prior art fuel system.

FIG. 1 discloses a fuel control system 100 especially for diesel vehicles. The fuel control system 100 includes a fuel tank 102, a fuel control device 120 (for example, a Stanadyne fuel control device) and associated fuel lines. The fuel tank 102 includes a supply line 104 and a return line 106. The fuel is supplied to an engine 180 from supply line 104 to a conduit 108 and into the fuel control device 120. When supplied to the fuel control device, the fuel passes through a fuel filter 122 to conduit 124 to supply a fuel pump 126. Upon exiting the fuel pump 126, the fuel is supplied to fuel conduits 127, 128 that pass the fuel to a fuel injection pump 130. The fuel injection pump can be a pump such as a Bosch Model VP-44 fuel injection pump. The fuel then exits the fuel injection pump 130 via a conduit 132 and returns to the fuel control device 120 and enters conduit 134. The fuel then exits the fuel control device 120 into conduit 136 and can be passed to a fuel cooler 150 via conduit 148. Also, fuel returns from engine cylinders 140, 142, 144 and 146 via conduit 138. This extra fuel is then returned to the fuel tank return line 106 by conduit 152.

Figure 2:
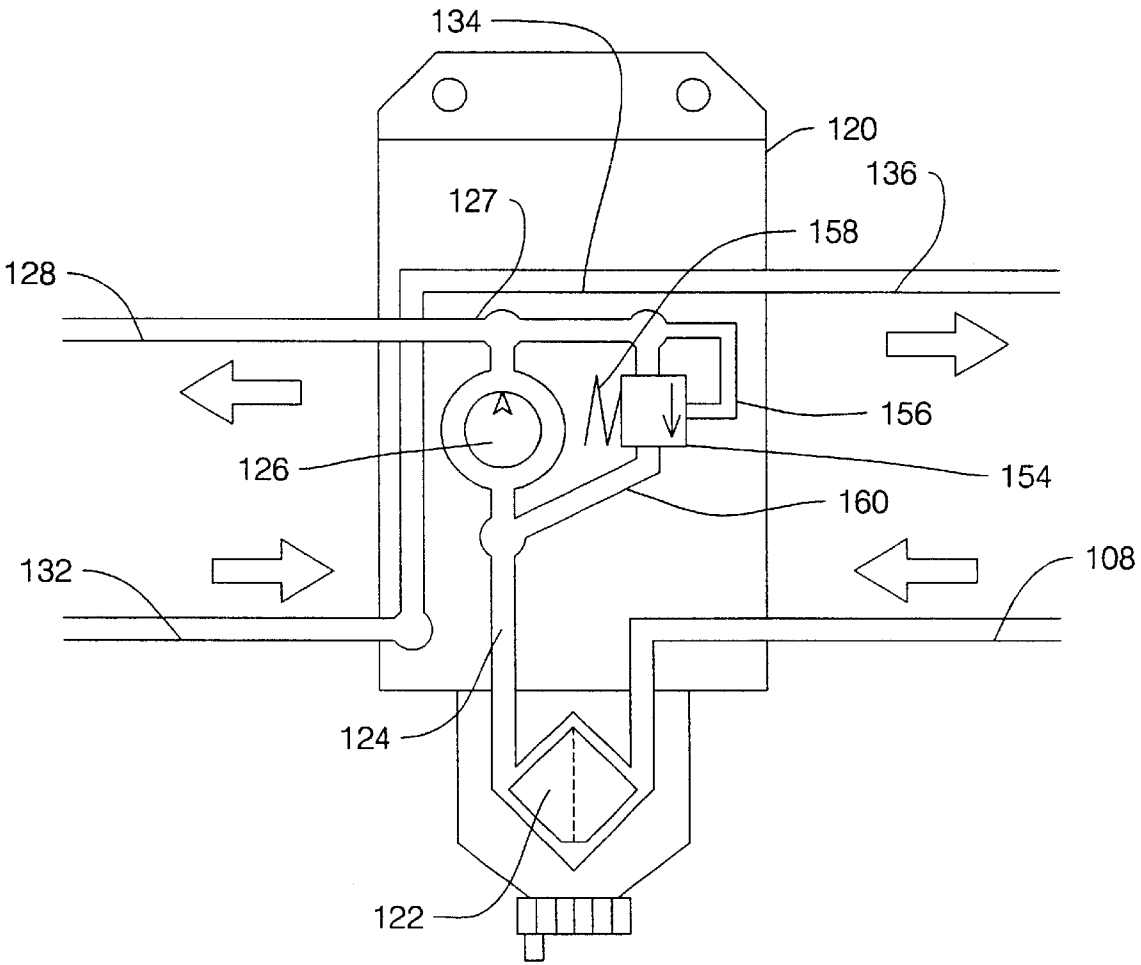
FIG. 2 (PRIOR ART)
FIG. 2 is a schematic view of the fuel control device illustrating the operation of a prior art fuel control device.

As clearly shown in FIG. 2, the fuel control device 120 includes a spring biased pressure relief valve 154. This valve 154 is operated to relieve excess pressure in conduits 127, 128. If the pressure is too high in these conduits, then the pressure in reduced diameter conduit 156 acts against the force of a spring 158 to move the valve 154 to the left thereby connecting conduit 127 with conduit 160 to return the excess fuel upstream of the fuel pump 126.

Figure 3:
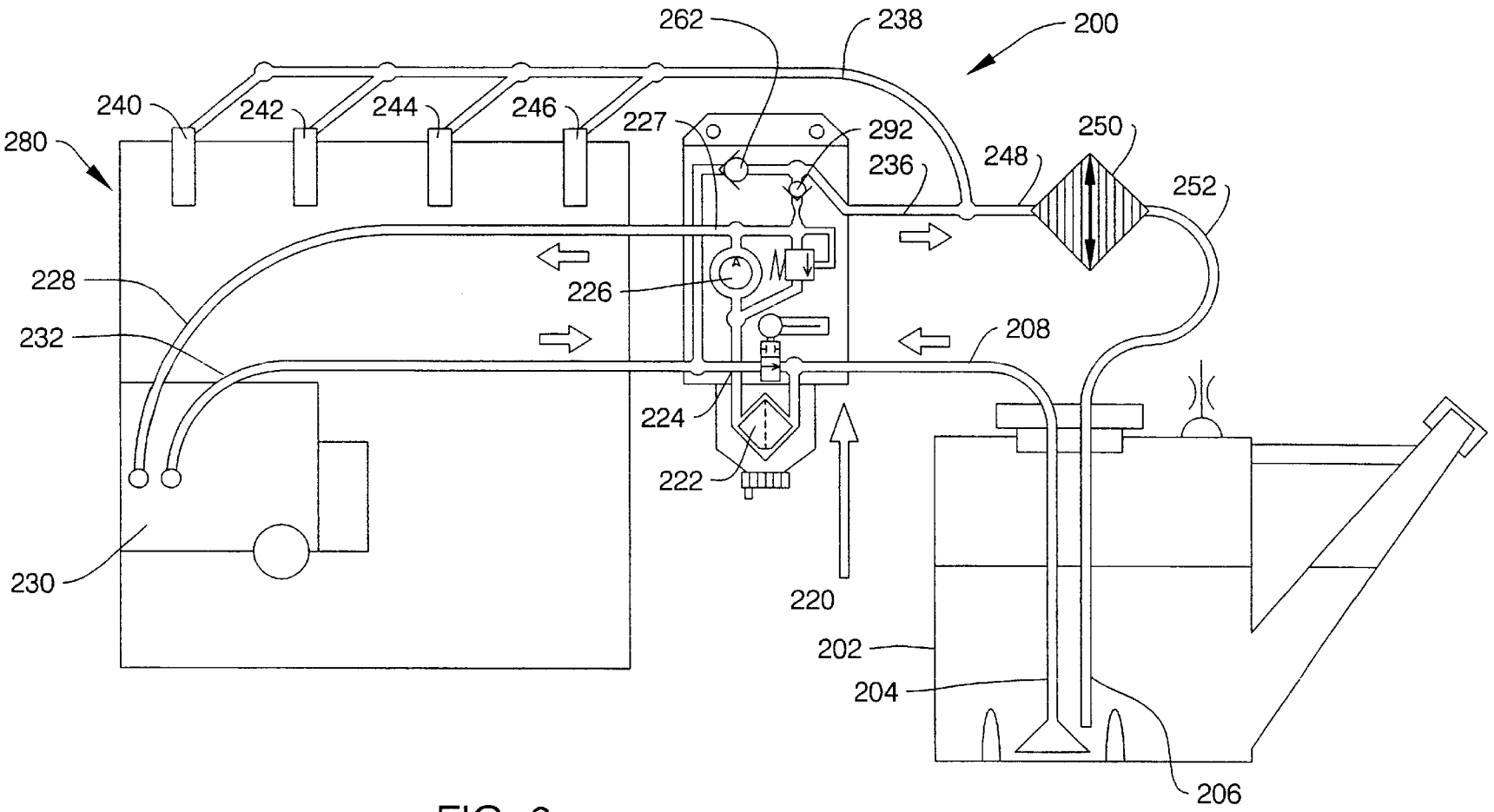
FIG. 3 is a schematic view of a diesel vehicle fuel system illustrating the operation of a fuel system according to a first embodiment of the present invention.

FIG. 3 discloses a fuel control system 200 that includes a fuel tank 202,.a fuel control device 220 and associated fuel lines. The fuel tank 202 includes a supply line 204 and a return line 206. The fuel is supplied to an engine 280 from supply line 204 to a conduit 208 and into the fuel control device 220. When supplied to the fuel control device 220, the fuel passes through a fuel filter 222 to conduit 224 to supply a fuel pump 226. Upon exiting the fuel pump 226, the fuel is supplied to fuel conduits 227, 228 that then pass the fuel to a fuel injection pump 230. The fuel then exits the fuel injection pump 230 via a conduit 232 and returns to the fuel control device 220. Upon entering the fuel control device 220, the fuel can pass into conduits 234, 235. If the fuel passes along conduit 234, it passes check valve 262. The fuel then exits the fuel control device 220 into conduit 236 and is passed to a fuel cooler 250 via conduit 248. Also, fuel returns from engine cylinders 240, 242, 244 and 246 via conduit 238. This extra fuel is then returned to the fuel tank return line 206 by conduit 252.

Figure 4:
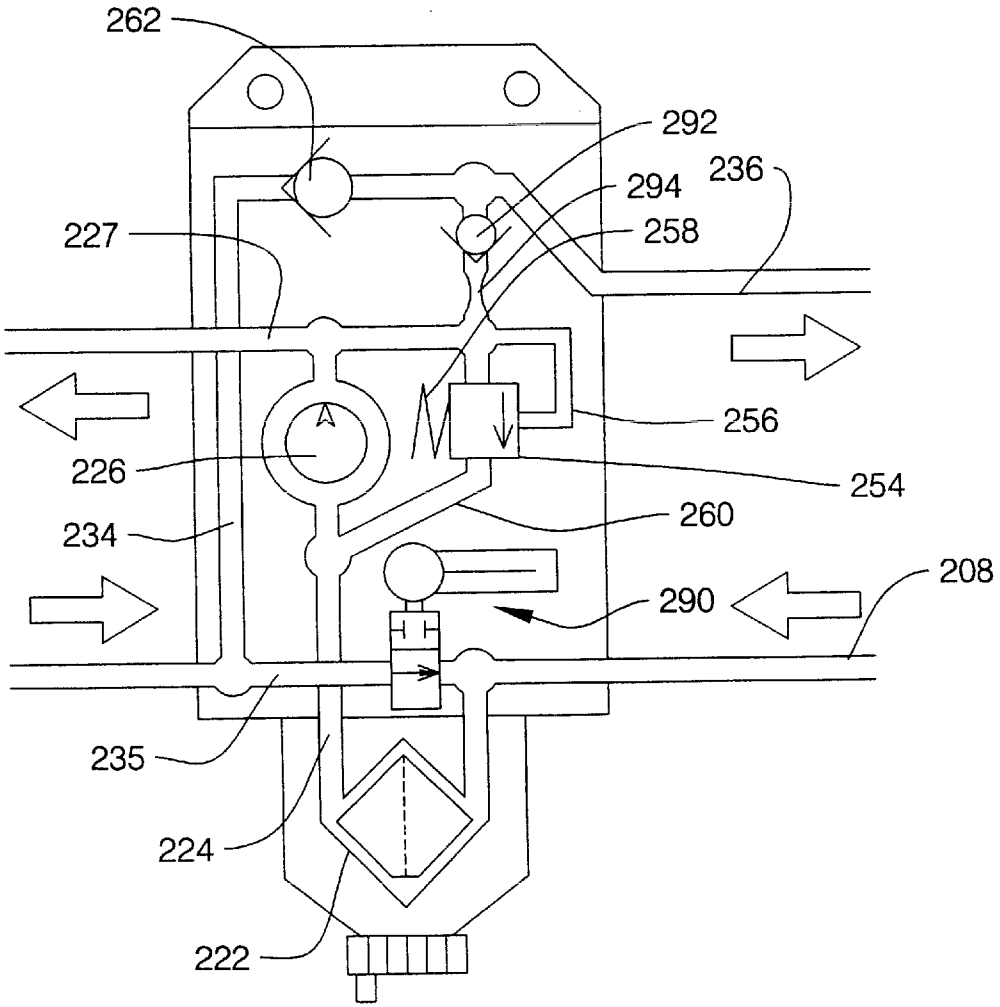
FIG. 4 is a schematic view of a fuel control device illustrating the operation of the fuel control device according to the embodiment shown in FIG. 3.

As clearly shown in FIG. 4, the fuel control device 220 includes a spring biased pressure relief valve 254. This valve 254 is operated to relieve excess pressure in conduits 227, 228. If the pressure is too high in these conduits, then the pressure in reduced diameter conduit 256 acts against the force of a spring 258 to move the valve 254 to the left thereby connecting conduit 227 with conduit 260 to return the excess fuel upstream of the fuel pump 226.

Also, a temperature sensitive two position diverter valve 290 is provided between conduit 235 and conduit 208. If it is detected that cold conditions exist, then the valve 290 is positioned as shown in FIGS. 3–4 so that return fuel is blended with the incoming supply fuel as it enters the fuel filter 222. If it is detected that hot conditions exist, the diverter valve is moved to the closed position substantially blocking return fuel from passing to the supply side of the fuel filter 222. Since the diverter valve 290 is in the closed position, the fuel can pass through the check valve 262 and return to the fuel tank 202.

A restriction 294 and a further check valve 292 are provided between the conduit 227 and conduit 236. This system allows a continuous air bleed to purge any incoming air or vapor from the fuel supply system back to the fuel tank 202. In the event that the fuel pump 226 should fail, the check valve 292 will prevent unfiltered fuel from being pulled along the fuel return line.

Figure 5:
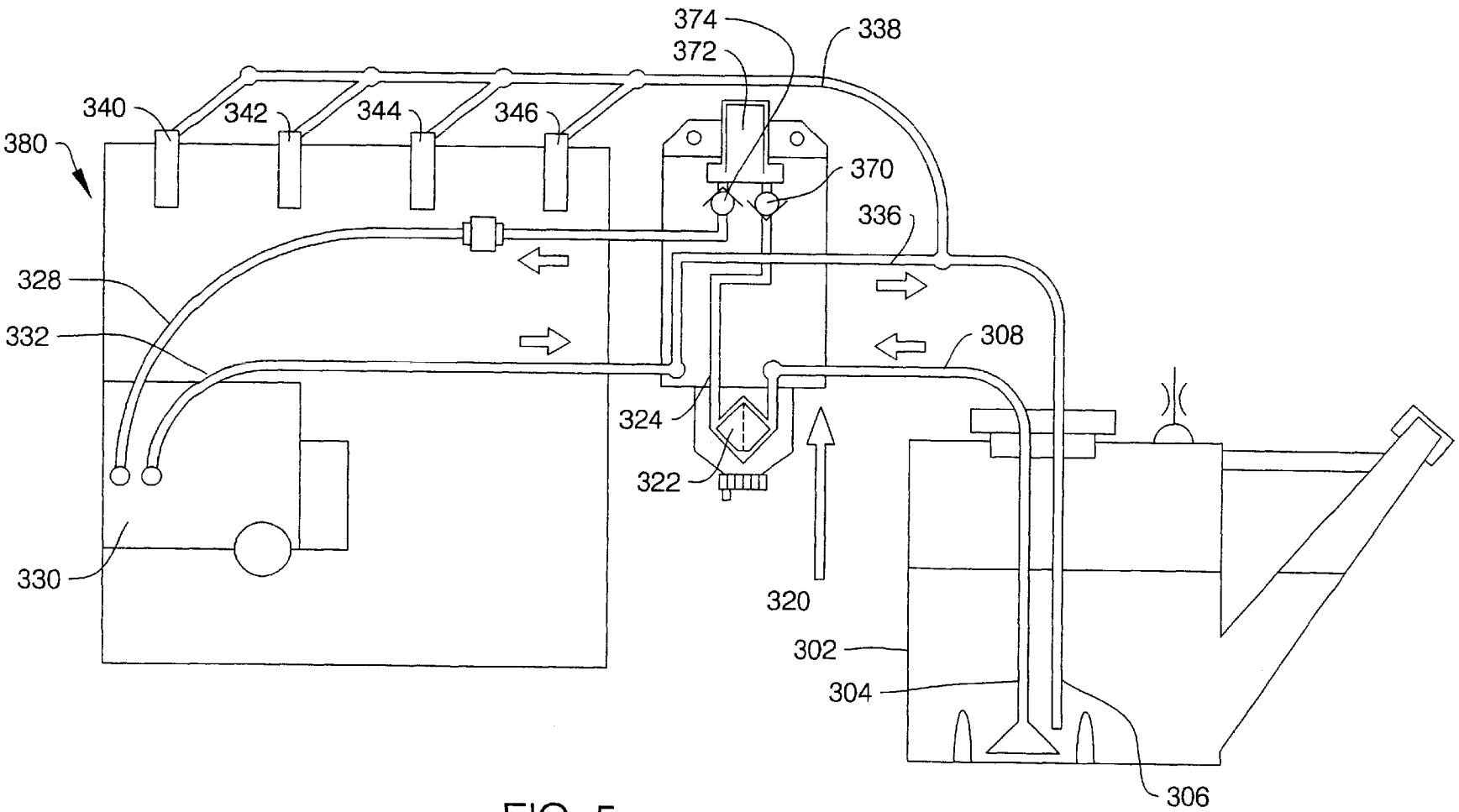
FIG. 5 (PRIOR ART)
FIG. 5 is a schematic view of a diesel vehicle fuel system illustrating the operation of another prior art fuel system.

FIG. 5 shows a prior art fuel control system including a hand primer according to another version of the prior art fuel control system including a hand primer 372. The reference numerals for FIG. 5 have been designated with a "3" in the hundreds position and similar numbers have been used to designate similar parts.

In this embodiment, after the fuel has passed through the fuel filter 322 into conduit 324, it flows past check valves 370 and 374 to supply fuel to conduit 328.

Figure 6:
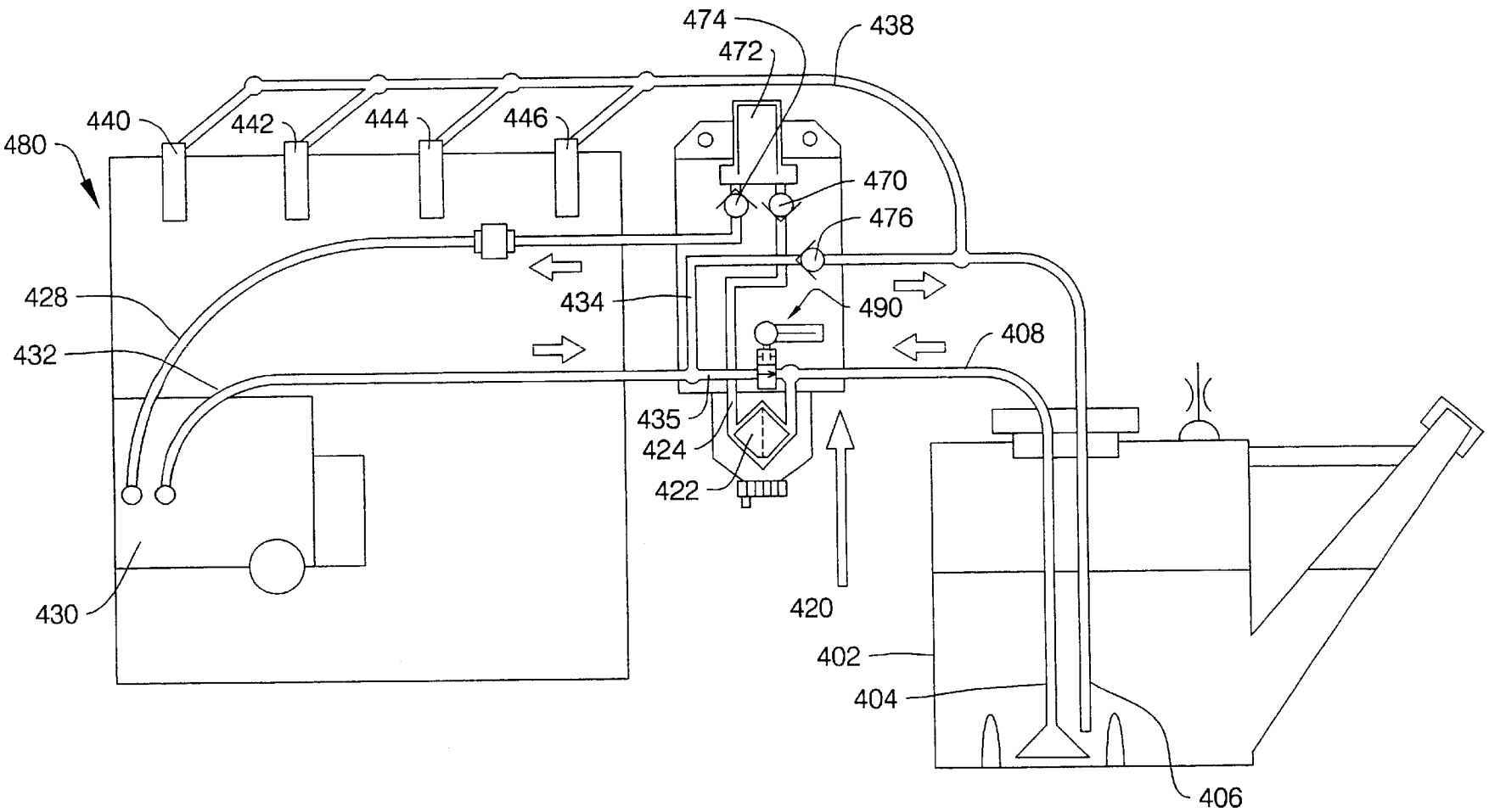
FIG. 6 is a schematic view of a diesel vehicle fuel system illustrating the operation of another fuel system according to a second embodiment of the present invention.

FIG. 6 shows a fuel control system including a fuel control device 420 and a hand primer 472. The reference numerals for FIG. 6 have been designated with a "4" in the hundreds position and similar numbers have been used to designate similar parts.

According to this embodiment, after the fuel has passed through the fuel filter 422 into conduit 424, it flows past check valves 470 and 474 to supply fuel to conduit 428.

A temperature sensitive two position diverter valve 490 is provided between conduit 435 and conduit 408. If it is detected that cold conditions exist, then the valve 490 is positioned as shown in FIG. 6 so that return fuel is blended with the incoming supply fuel as it enters the fuel filter 422. If it is detected that hot conditions exist, the diverter valve is moved to the closed position substantially blocking return fuel from passing to the supply side of the fuel filter 422. Since the diverter valve 490 is in the closed position, the fuel can pass through the check valve 476 and return to the fuel tank 402.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A fuel control device comprising:

a housing;

a fuel inlet port disposed in the housing;

a fuel filter operatively connected to the fuel inlet port;

a fuel pump operatively connected between the fuel filter and a filtered fuel outlet port disposed in the housing;

an injection pump supply conduit disposed between an exit of the fuel pump and the filtered fuel outlet port;

a fuel return inlet port and a fuel return outlet port;

a fuel return conduit disposed between the fuel return inlet port and the fuel return outlet port, the fuel return conduit including a check valve disposed therein for preventing fuel from returning through the fuel return outlet port and exiting the fuel return inlet port;

a temperature control valve operatively disposed between the fuel inlet port and the fuel return inlet port, the temperature control valve having at least a first and second position, the first position allowing fuel supplied to the fuel return inlet port to be mixed with fuel supplied to the fuel inlet port and supplied to the fuel filter and the second position blocking flow of fuel supplied to the fuel return inlet port from mixing with fuel supplied to the fuel inlet port;

a restriction located between the injection pump supply conduit and the fuel return conduit, the restriction being disposed above the injection pump supply conduit, wherein the restriction allows air entrapped in the fuel control device to bleed out of the fuel control device; and a further check valve disposed between the restriction and the fuel return conduit for preventing unfiltered fuel from being passed from the fuel return outlet port to the filtered fuel outlet port.

* * * * *